United States Patent [19]

Richard

[11] Patent Number: 4,642,830

[45] Date of Patent: Feb. 17, 1987

[54] BRIDGE TRUSS, BRIDGE SPAN INCLUDING SUCH TRUSSES, AND METHOD OF CONSTRUCTING THE TRUSS

[75] Inventor: Pierre Richard, Neuilly s. Seine, France

[73] Assignee: Bouygues, Clamart, France

[21] Appl. No.: 679,554

[22] Filed: Dec. 7, 1984

[30] Foreign Application Priority Data

Dec. 7, 1983 [FR] France ..... 83 10584

[51] Int. Cl.[4] ..... E01D 7/02

[52] U.S. Cl. ..... 14/4; 14/13; 14/23; 52/223 R; 52/693

[58] Field of Search ..... 14/1, 3, 4, 7, 13, 14, 14/15, 17, 22, 23; 52/223 R, 600, 693; 104/24

[56] References Cited

U.S. PATENT DOCUMENTS 3,027,633 4/1962 Murphy ..... 14/1 X
3,145,540 8/1964 Baittinger ..... 52/223 R X
4,282,619 8/1981 Rooney ..... 52/693 X

FOREIGN PATENT DOCUMENTS 1391192 1/1965 France .
51843 10/1966 Poland ..... 14/3

OTHER PUBLICATIONS

"Kuwait's Bubiyan Bridge—a 3-D Precast Segmental Space Frame", *PCI Journal,* Jan./Feb. 1983, twenty pages.

*Primary Examiner*—James A. Leppink
*Assistant Examiner*—John F. Letchford
*Attorney, Agent, or Firm*—Fleit, Jacobson, Cohn & Price

[57] ABSTRACT

A prefabricated three-dimensional truss structure for a bridge, or the like, the truss formed from bars arranged to define triangular or rectangular patterns. The bars are formed from prestressed, high-strength concrete that are connected at their ends with assembly blocks that are prestressed, the prestress being preferably provided by the cables that prestress the bars, and which terminate at the blocks. A plurality of such unit trusses can be assembled to provide a truss structure for a bridge span, and the trusses can assume a wide variety of configurations.

9 Claims, 5 Drawing Figures

BRIDGE TRUSS, BRIDGE SPAN INCLUDING SUCH TRUSSES, AND METHOD OF CONSTRUCTING THE TRUSS

The invention relates to bridges.

BACKGROUND OF THE INVENTION

One known technique of building a bridge consists in prefabricating unit transverse bridge sections, and in placing these sections in situ by means of a launching girder, the set of sections composing a span being cantilevered out until it is integrated in the final structure.

This construction technique was used in particular to build the Bubiyan bridge in Kuwait (see PCI Journal of prestressed concrete institute January/February 1983, vol 28 no. 1, pp. 68–107) with a cantilevered length of about 40 m, which is a considerable achievement.

The technique of cantilevered placement enables shorter placement cycles to be obtained than are possible with any other known technique, however, it is rapidly limited by the weight of the cantilevered assembly, since excessive weight would lead to a launching girder whose size, weight and cost would be exorbitant.

Preferred embodiments of the present invention enable a bridge to be built by means of this technique with a cantilevered length that may be as much as 200 meters (m), but without requiring an exorbitant launching girder.

SUMMARY OF THE INVENTION

According to the present invention, this is achieved by the fact that transverse bridge sections are prefabricated which are essentially constituted by a three-dimensional truss made of high strength prestressed concrete bars without a deck, that the transverse sections are placed in situ, and by the fact that members which make up the deck of the span are subsequently placed on the set of transverse sections that make up a span.

Concrete of high mechanical strength has been known for a long time, in particular from the work of Monsieur Freyssinet (see, for example, French patents Nos. 764 505, 781 388, 797 785 and the second addition No. 46 379 to French patent No. 722 338). However, such concrete has up to the present remained a laboratory item. The applicant has developed a technique for making such concrete on an industrial scale, and this technique is the subject matter of French patent application No. 83 10057 filed June 17th, 1983. This technique makes it possible, in particular, to provide concrete beams having a working load of 50 MPa to 100 MPa or more, while the admissible working load on conventional prestressed concrete is about 10 MPa to 20 MPa.

In a bridge made in accordance with the present invention, the resistance of the span to longitudinal bending is ensured by the truss, with the deck contributing only to resistance to transverse bending.

A unit three-dimensional truss made of prestressed high strength concrete is itself a new product and constitutes one of the aspects of the invention.

In a typical example, the bars are disposed with some of the bars occupying two superposed horizontal planes, and with the other bars being disposed obliquely in the resulting space to interconnect the two planes, the set of bars being held in the desired configuration by assembly blocks of cast concrete.

In each of the parallel planes, the bars are placed in a freely chosen pattern, with the most common patterns being patterns based on the sides of rectangles, patterns based on lines connecting the middles of the sides of rectangles, patterns based on lines connecting the center of a rectangle to the vertices or to the middles of the sides thereof, and patterns based on the risers and the rungs of a ladder. These examples are not limiting.

The bars disposed in the space between the two planes are preferably disposed so that some are in vertical planes and others are in planes inclined to the vertical.

The blocks for assembling the bars are preferably triaxially prestressed blocks, and the prestress is preferably provided by the cables for prestressing bars which end at the blocks. These blocks themselves may advantageously be made of prestressed high strength concrete.

The deck of a bridge in accordance with the invention may be a metal deck or it may be a concrete deck, and it is generally constituted by prefabricated transverse deck sections which are placed one after the other. When the transverse sections are made of concrete, they are preferably conjugate, that is to say that the end face of a section which has already been made is used as one of the walls of the casing for casting the next section. Likewise, the blocks of two contiguous trusses are preferably conjugate blocks.

BRIEF DESCRIPTION OF THE DRAWINGS

An embodiment of the invention is described by way of example with reference to the accompanying drawings, in which.

MORE DETAILED DESCRIPTION

Figure 1:
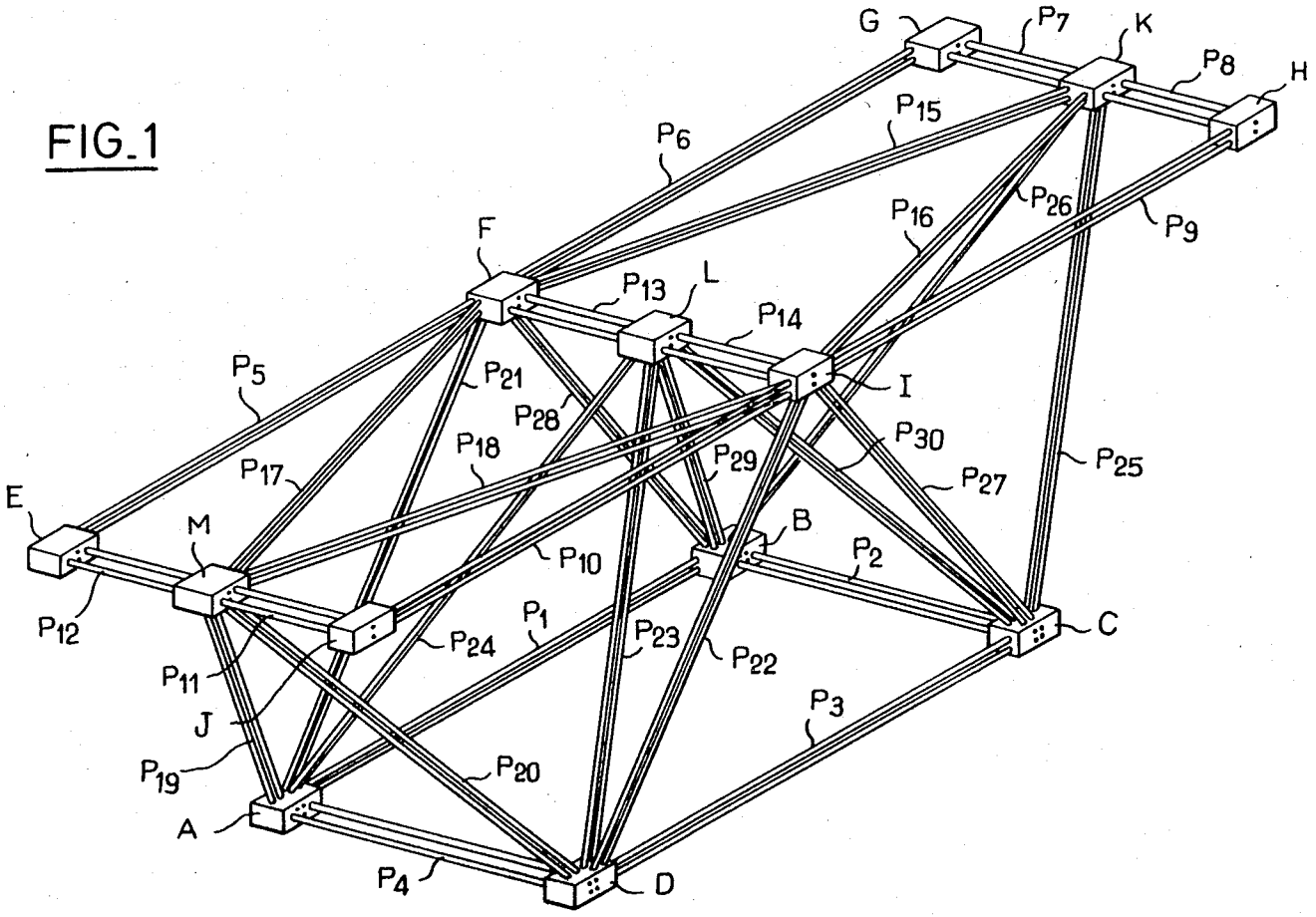
FIG. 1 is a perspective view of an example of a unit truss.

It has already been explained that a unit truss, ie. the truss cross section which, by piece-by-piece assembly with identical or analogous truss sections builds up the truss of a bridge span, may have a wide variety of configurations. FIG. 1 shows an example of a configuration which has been studied in depth, but which is not to be considered as being limiting.

In this example, the following points can be seen:

The truss includes a lower plane constituted by bars P1 to P4 disposed along the sides of a rectangle whose vertices are constituted by assembly blocks A, B, C, and D.

The truss includes an upper plane constituted by bars P5 to P14 disposed along the sides touching rectangles whose vertices are constituted by assembly blocks E to J, with the common side FI and the two opposite end sides EJ and GH further including mid point assembly blocks L, M and K, with other bars P15 to P18 diagonally connecting the block M to the blocks F and I, and the block K to the blocks F and I.

The two planes are interconnected by bars rising from the lower blocks and ending at some of the upper blocks. Bars P21, P22, P27 and P28 are situated in two vertical planes respectively determined by the blocks C, D, I and the blocks A, B, F, and bars P19, P20, P25, and P26 are situated in two inclined planes respectively determined by the blocks B, C, K and A, D, M, with the two planes being further interconnected by bars P23, P24, P29 and P30 disposed along the edges of a pyramid whose base is constituted by the blocks A, B, C, and D and whose apex is constituted by the block L.

In the example shown, each bar of the truss is constituted by two parallel bars.

These bars are prefabricated by any suitable technique, and one such technique is described below by way of example.

The shape, size and cross section of the bars can be freely chosen. Preference is given to cylindrical bars having a diameter of 25 mm to 35 mm.

To make the truss, the prefabricated bars are placed in their desired relative positions, casings are placed for making the assembly blocks and the assembly blocks are cast. If it is desired to make the assembly blocks out of high strength concrete, the casing must withstand the injection pressure of the concrete (eg. 50 bars to 60 bars).

A typical truss weighs 5 tonnes (ie. metric tons) per linear meter for a bridge which is 18 meters wide. Thus, using a girder capable of placing 1,000 tonnes, it is possible to make a span of 200 meters.

Figures 2, 3:
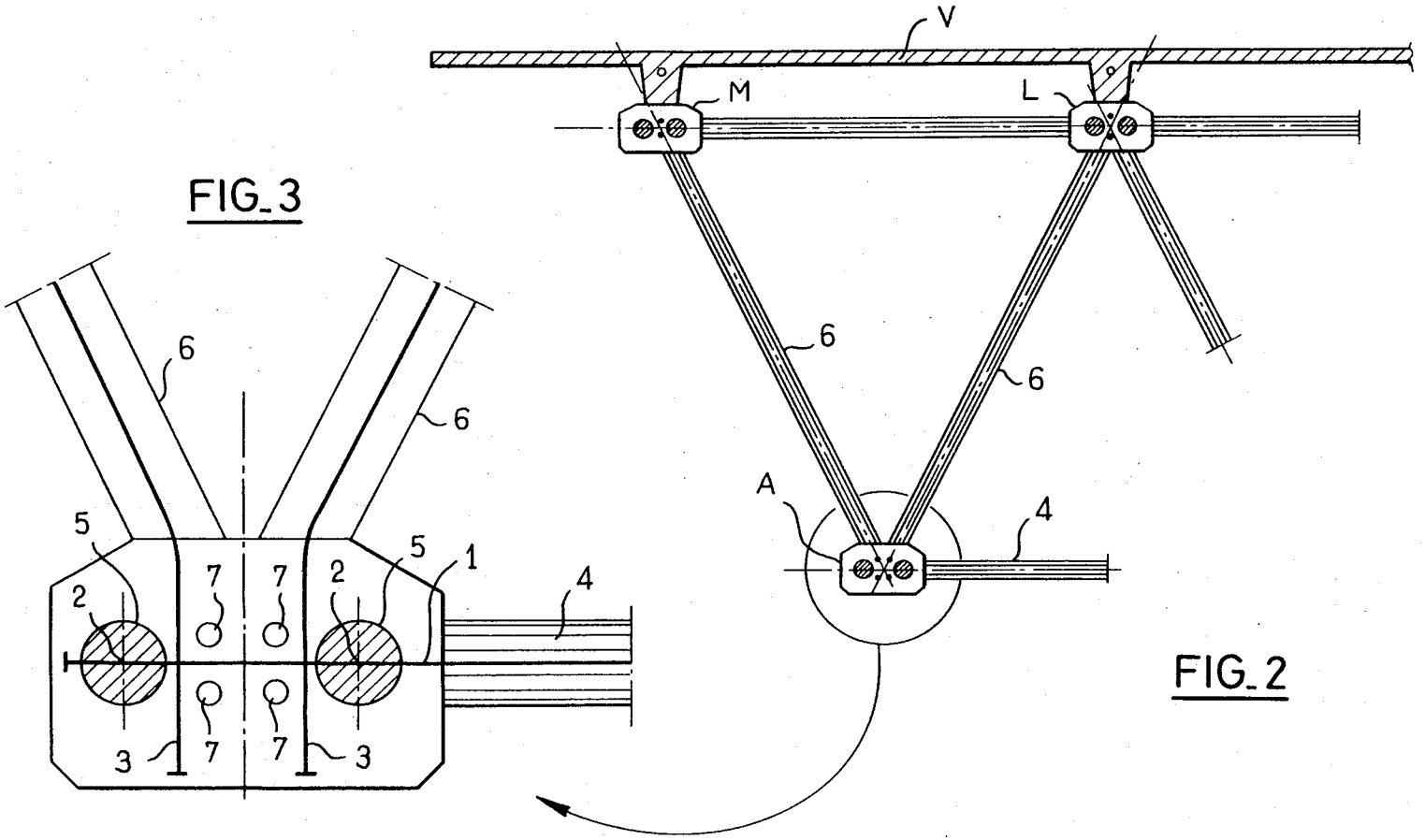
FIG. 2 is a cross section through a portion of a unit truss after the truss has been put into place and has received a section of bridge deck.
FIG. 3 is a diagram of an example of an assembly block for the bars of a unit truss.

FIG. 2 is a vertical section through the truss in place after a deck unit V has been placed thereon.

FIG. 3 is a view on a larger scale of one of the assembly blocks of the truss shown in FIG. 2. In this example, the block is prestressed in three dimensions by cables 1, 2 and 3 coming from the horizontal bars 4 and 5 and the rising bars 6 which terminate at the block. The prestress which was in the bars passes into the node and the bars set up pressure stresses in the block. The cables 1, 2 and 3 may be put under tension before, during or after the block is cast.

Further, some of the blocks, such as the block shown in FIG. 3 have cables passing freely therethrough, such as cables 7 which are put under tension when an entire span of trusses has been put into place. These cables are overall prestress cables and contribute to the overall bending strength by providing longitudinal prestress.

Figure 4:
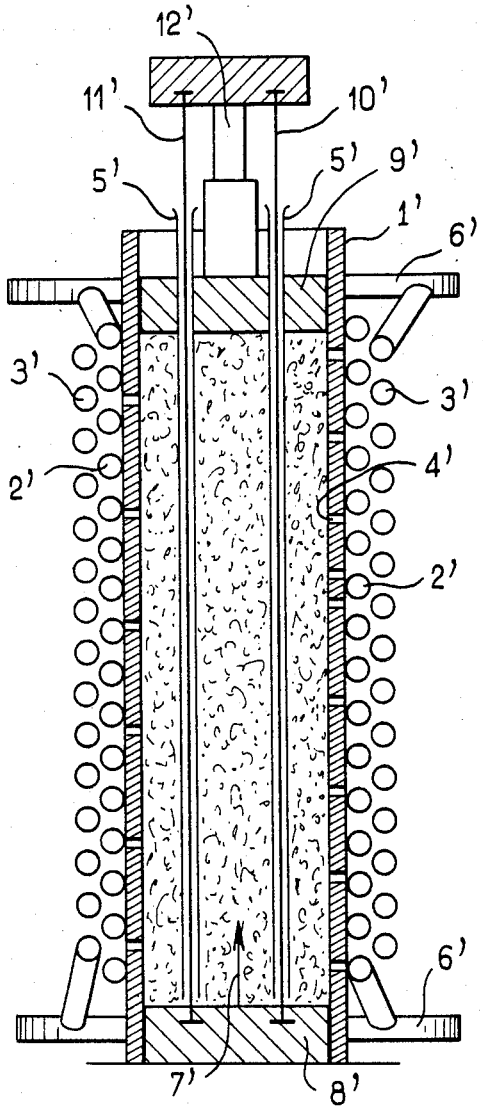
FIG. 4 is a longitudinal section through a bar of the truss during fabrication.
Figure 5:
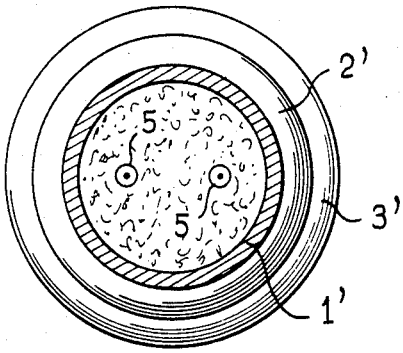
FIG. 5 is a cross section through the FIG. 4 bar.

FIGS. 4 and 5 relate to a method of fabricating a bar of the truss in which the concrete of the bar is set in a rectilinear tubular envelope which is surrounded by binding, to enable the concrete to be compressed during setting by applying longitudinal force to give a pressure in the range 50 MPa to 150 MPa. The longitudinal compression causes the concrete to exert transverse outward pressure on the envelope, thereby putting the binding under tension.

For example, (see FIGS. 4 and 5), a cylindrical tube 1' is preferably disposed vertically. It may be made of thin metal sheet (eg. about 2 mm thick) or of tough card or of plastic. The wall of the tube has multiple drainage perforations 4' and the tube is bound by helically winding two layers of steel wire 2' and 3' around the tube. One layer is wound clockwise and the other layer is wound anticlockwise. At this stage, the winding 2' is in contact with the tube 1' and the winding 3' surrounds the winding 2', but neither winding is under tension.

Means are provided for fixing each end of the winding relative to the corresponding end of the other winding, eg. by fixing both corresponding end to means that also serve to fix the ends to an end of the tube 1'. An example of such means is constituted by a circle 6' which surrounds the tube 1' and to which both of the corresponding ends of the binding wires are fixed. A similar circle is applied to each end of the tube 1'.

One or more longitudinal drains 5' are disposed inside the tube. They are preferably constituted by steel tubes which are thicker than the tube 1' (if it too is made of steel), eg. tubes having a wall thickness of 4 mm to 6 mm.

The material and the thickness of the tubular envelope 1' are chosen so that the tube distributes forces and withstands shear from the binding.

Liquid concrete is inserted into the space between the outer tube 1' and the or each drain 5'. The liquid concrete may be a mixture of aggregate, sand, cement, and water which is known per se, and a priori the aggregate is of the same nature as the aggregate of conventional concrete. However, the aggregate is preferably selected from high quality concrete aggregates, in particular rock aggregates capable of withstanding pressures in the range 200 MPa to 300 MPa (ie. some limestones, sandstones, etc . . . ). The binder may likewise be a binder such as is used for conventional concrete, and this may include resin-based binders. The percentages of aggregate and binder may be the same as in conventional concrete.

Axial pressure 7' in the range 50 MPa to 150 MPa is applied to the mixture before and during setting until the concrete is hard. A portion of the water initially contained in the concrete seeps out through the orifices 4' through the outer tube 1' and via the or each drain tube 5'. The orifices 4' may be mere pores.

To apply the axial pressure without buckling the tube, the invention provides for placing two plates in respective ends of the tubes and then drawing the plates towards each other by means of one or more prestress cables passing longitudinally through the concrete and drawn by a jack. Such a system is shown diagrammatically in FIG. 4 where the pressure plates 8' and 9' are drawn towards one another by cables 10' and 11' which are drawn by a jack 12' which bears against the said other plate. Advantageously the cables 10' and 11' pass through the drainage tubes 5'.

The compression may be constant or otherwise, and it may be applied continuously or otherwise.

Under the effect of the longitudinal compression of the concrete, the binding is put under tension thus providing three-dimensional compression, with the binding providing reaction to the pressure in transverse planes and with the pressure-generating end plates containing the pressure along a third or longitudinal direction.

In some cases, and in particular for very long bars, the operation may be performed in successive layers of concrete, waiting for one layer to set before the next layer is made.

A typical method of making a bridge in accordance with the invention consists in performing the following operations:

prefabricating the prestressed high strength concrete bars;

using the bars to make up three-dimensional unit trusses with the bars being assembled by means of cast assembly blocks;

placing the unit trusses in situ side-by-side by means of a launching girder until a cantilevered assembly of the desired span length has been built;

prestressing this assembly; and placing deck units on the assembly of unit trusses to build up the deck of the span.

The deck is generally made of prestressed high strength concrete, but it may be made of metal.

The invention is not limited to the particular embodiments described above.

I claim:

1. A prefabricated concrete three-dimensional unit truss for a bridge, wherein the unit truss is constituted by bars of prestressed high strength concrete interconnected by blocks.

2. A truss according to claim 1, wherein the bars are disposed in parallel pairs.

3. A truss according to claim 1, wherein the block include passages to allow free passage of cables for prestressing the assembly of trusses that make up a span.

4. A truss according to claim 1, wherein the blocks are made of high strength concrete.

5. A bridge span comprising a plurality of three-dimensional trusses according to claim 1, said trusses being maintained assembled to one another by prestress cables.

6. A truss according to claim 1, wherein some of said bars are lying in two superposed horizontal planes leaving a space between the planes, while other bars are disposed obliquely across said space to interconnect the two planes, the bar assembly being maintained in the desired configuration by assembly blocks of cast concrete.

7. A truss according to claim 6, wherein the bars which are disposed across said space include box structure bars lying in vertical planes and bars lying in planes which are inclined to the vertical.

8. A truss according to claim 1, wherein the bar-assembly blocks comprise blocks which are three-dimensionally prestressed.

9. A truss according to claim 8, wherein a three-dimensionally prestressed block is prestressed by cables which prestress the bars interconnected by said block.

* * * * *